US008926257B2

(12) United States Patent
Bradley et al.

(10) Patent No.: US 8,926,257 B2
(45) Date of Patent: Jan. 6, 2015

(54) GRIPPING DEVICE FOR ARTICULATED WORK MACHINE

(75) Inventors: Nathan Bradley, Muscatine, IA (US); Matthew J. Hennemann, Burlington, IA (US); Michael R. Heiar, West Burlington, IA (US); Bradley O'Connor, Burlington, IA (US); David J. Sanning, Burlington, IA (US); Matthew Wagenbach, Burlington, IA (US)

(73) Assignee: CNH Industrial America LLC, New Holland, PA (US)

( * ) Notice: Subject to any disclaimer, the term of this patent is extended or adjusted under 35 U.S.C. 154(b) by 379 days.

(21) Appl. No.: 13/343,781

(22) Filed: Jan. 5, 2012

(65) Prior Publication Data

US 2013/0177382 A1 Jul. 11, 2013

(51) Int. Cl.
*E02F 3/40* (2006.01)

(52) U.S. Cl.
USPC ..... 414/722; 37/117.5; 37/406; 37/466; 294/104; 414/740

(58) Field of Classification Search
CPC ..... B66F 3/36; E02F 7/026; E02F 3/30; E02F 3/32; E02F 3/38; E02F 3/40; E02F 3/96; E02F 3/382; E02F 3/404; E02F 3/413; E02F 3/431; E02F 3/435; E02F 3/961; E02F 3/962; E02F 3/963; E02F 3/964; E02F 3/3604; E02F 3/4133; E02F 3/4135
USPC ..... 37/403, 406; 414/704, 722–724, 727, 414/729, 739, 740, 912; 405/174, 179, 405/184.1; 294/104, 902; 269/271–281
See application file for complete search history.

(56) References Cited

U.S. PATENT DOCUMENTS

| | | | | |
|---|---|---|---|---|
| 3,120,310 | A | 2/1964 | Roberts et al. | |
| 3,353,285 | A | 11/1967 | Murray | |
| 4,407,626 | A | 10/1983 | Bruckner | |
| 4,517,755 | A * | 5/1985 | Nicholson | 37/404 |
| 4,770,597 | A | 9/1988 | Powers | |
| 5,678,332 | A * | 10/1997 | Hawkins | 37/403 |
| 6,203,267 | B1 | 3/2001 | Heiple et al. | |
| 6,209,237 | B1 | 4/2001 | Heiple et al. | |
| 7,037,064 | B2 | 5/2006 | Heiple | |
| 2006/0283056 | A1 * | 12/2006 | Risch et al. | 37/466 |
| 2009/0290966 | A1 * | 11/2009 | King | 414/739 |
| 2010/0308609 | A1 * | 12/2010 | LaValley et al. | 294/81.61 |

FOREIGN PATENT DOCUMENTS

| | | |
|---|---|---|
| GB | 2186258 | 8/1987 |

* cited by examiner

*Primary Examiner* — Saul Rodriguez
*Assistant Examiner* — Ronald Jarrett
(74) *Attorney, Agent, or Firm* — Patrick M. Sheldrake; Seyed V. Sharifi T.

(57) ABSTRACT

A work machine includes a pivotable arm having a first gripping device formed therein, the arm operatively connected to an attachment for securing an object between the first gripping device and the attachment. A second gripping device is removably securable to the arm near the first gripping device, the second gripping device configured to at least partially secure an object between the second gripping device and the attachment.

17 Claims, 9 Drawing Sheets

GRIPPING DEVICE FOR ARTICULATED WORK MACHINE

FIELD OF THE DISCLOSURE

The present disclosure relates generally to the field of work machines. It relates more particularly to articulated work machines.

BACKGROUND OF THE DISCLOSURE

Articulated work machines, such as a loader backhoe, also referred to as a backhoe, are commonly used on job sites. The backhoe may be used to manipulate an object by securing the object between a dipper arm and an attachment, such as a bucket. Teeth formed along an edge of the dipper arm can assist with this task. However, there can be shortcomings associated with the formed teeth. For example, the formed teeth pattern, having a triangular profile similar to that of a saw blade may work well for certain applications, but not others, such as manipulation of metal pipes, in which the teeth may cause damage to the pipe. Additionally, applications associated with abrasive objects can "wear out" the teeth, possibly requiring replacement of the dipper arm.

Accordingly, there is an unmet need to provide a removable gripping device associated with the dipper arm that could supplement or be installed over the existing formed dipper teeth, providing an inexpensive attachment that greatly increases the operational versatility of articulated work machines.

SUMMARY OF THE DISCLOSURE

The present disclosure relates to a work machine including a pivotable arm having a first gripping device formed therein, the arm operatively connected to an attachment for securing an object between the first gripping device and the attachment. The second gripping device is removably securable to the arm near the first gripping device, the second gripping device configured to at least partially secure an object between the second gripping device and the attachment.

The present disclosure further relates to a second gripping device removably securable to a pivotable arm of a work machine having a first gripping device formed therein. The second gripping device is securable near the first gripping device, the arm operatively connected to an attachment for securing an object between the first gripping device and the attachment. The second gripping device is removably securable to the arm near the first gripping device, the second gripping device configured to at least partially secure an object between the second gripping device and the attachment.

The present disclosure yet further relates to a method for operating a work machine including providing a pivotable arm having a first gripping device formed therein. The arm is operatively connected to an attachment for securing an object between the first gripping device and the attachment. A second gripping device is removably securable to the arm near the first gripping device. The method further includes operating the pivotable arm and the attachment such that the second gripping device at least partially secures an object between the second gripping device and the attachment.

An advantage of the present disclosure is enhanced versatility for articulating work machines.

A further advantage of the present disclosure is an inexpensive gripping device associated with the operation of articulating work machines.

An embodiment of the present disclosure may include one or more of the advantages identified above.

The features as discussed above, as well as other features and advantages of the present disclosure, will be appreciated and understood by those skilled in the art from the following detailed description and drawings.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
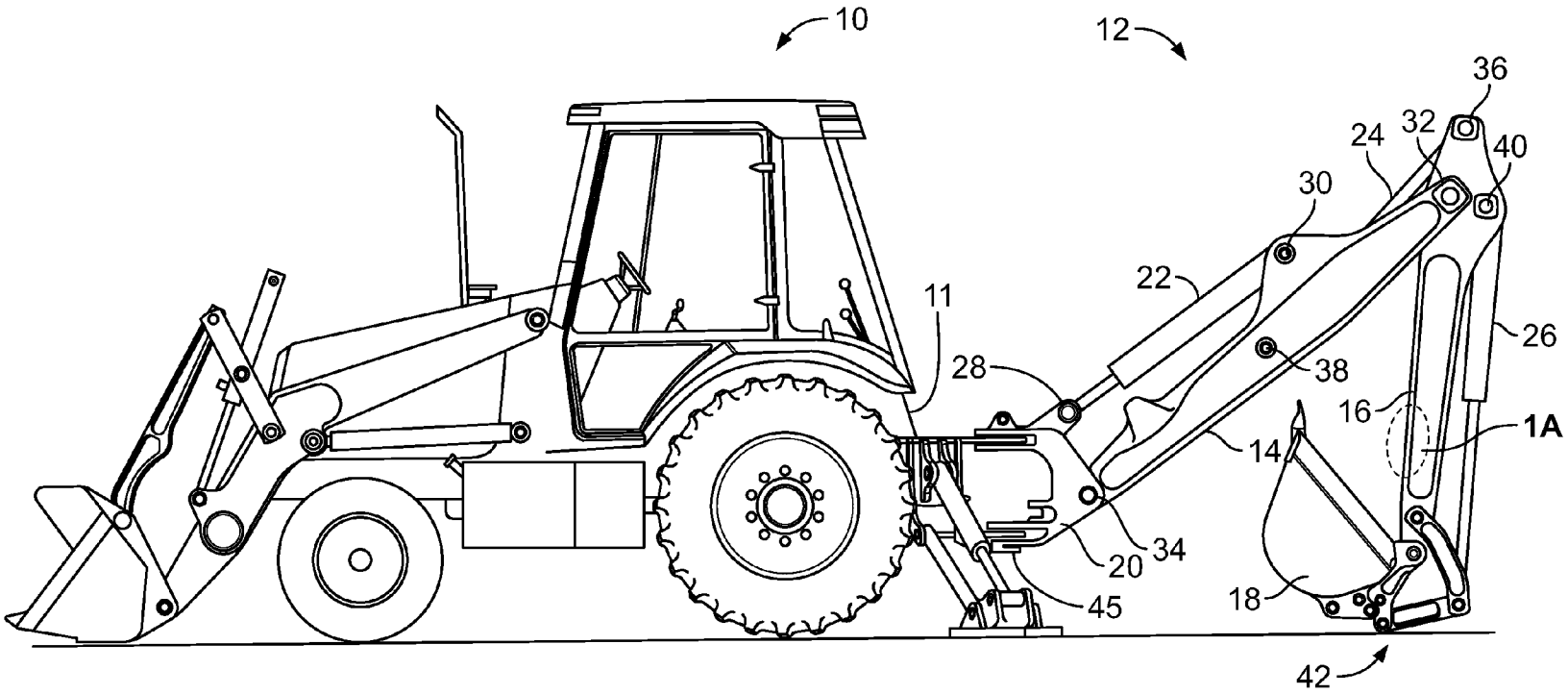
FIG. 1 is a side view of an embodiment of a work machine of the present disclosure.

Referring to the drawings for a description of an articulated earthworking machine 10, sometimes referred to as an excavator, that employs the present disclosure, FIG. 1 shows a third portion or boom 14 in a lowered position. Boom 14 pivots about a pivot joint 34 and coincident pivot axis of a second portion or swing frame or frame 20 and is controlled by extension/contraction of a fluid ram 22 connected between pivot joints 28, 30. Frame 20 pivots about a pivot joint 45 with respect to a first portion or base frame 11 of the machine. Similarly, an arm 16, often referred to as a dipper, pivots about pivot joint 32 of boom 14 and is controlled by extension/contraction of fluid ram 24 connected between pivot joints 36, 38. In addition, attachment or implement 18, such as a bucket, is pivotably connected to arm 16 and is controlled by extension/contraction of a fluid ram 26 connected between pivot joint 40 and interconnected linkages 42. A backhoe 12 comprises the combination of boom 14, arm 16, implement 18 and pivoting connections therebetween.

As used herein, the term articulated, as in articulated machine indicates that the machine includes articulations, articulating or pivotable or pivot joints or connections, which terms may be used interchangeably.

Figure 1A:
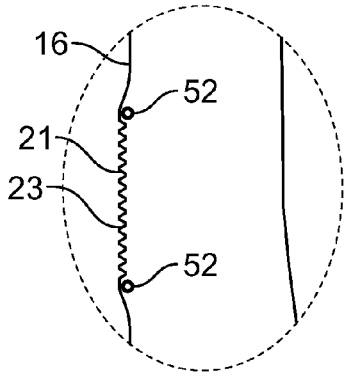
FIG. 1A is a partial enlarged view of the arm of a work machine as shown in FIG. 1.

As further shown in FIG. 1A, arm 16 further includes a first gripping device 21 having a first gripping feature 23. Additionally, near first gripping device 21, a pair of slots 52 may be formed in arm 16 for securing a second gripping device 44 (FIG. 2A), as will be discussed in further detail below.

Figure 2A:
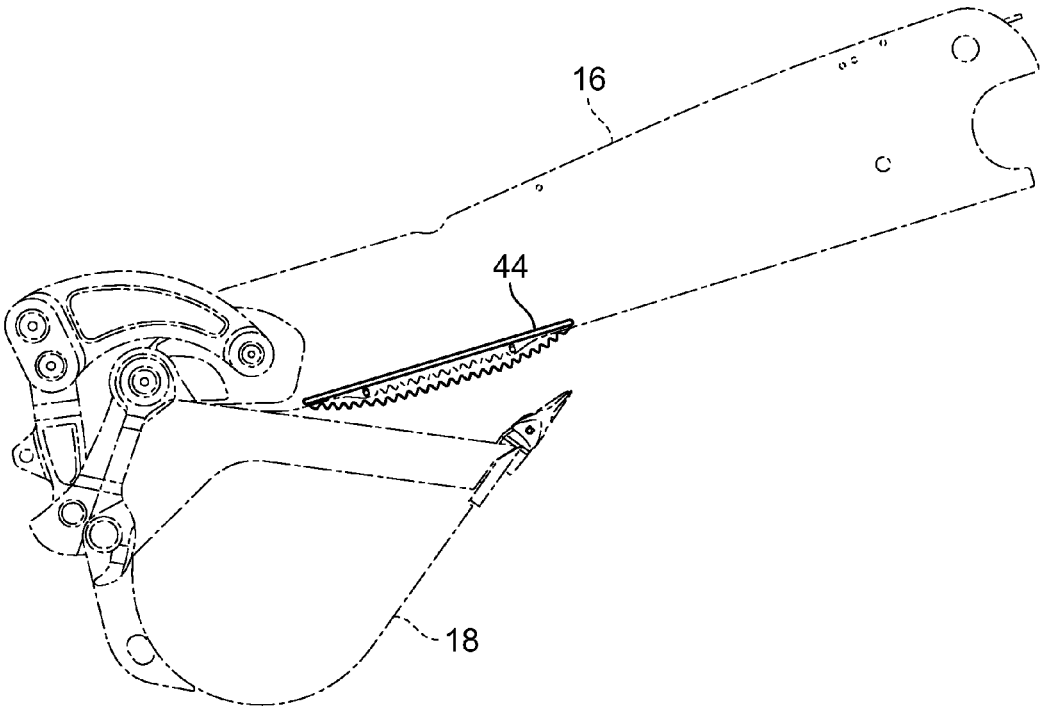
FIGS. 2A and 2B are different views of an exemplary embodiment of a second gripping device installed on a work machine of the present disclosure.
Figure 2B:
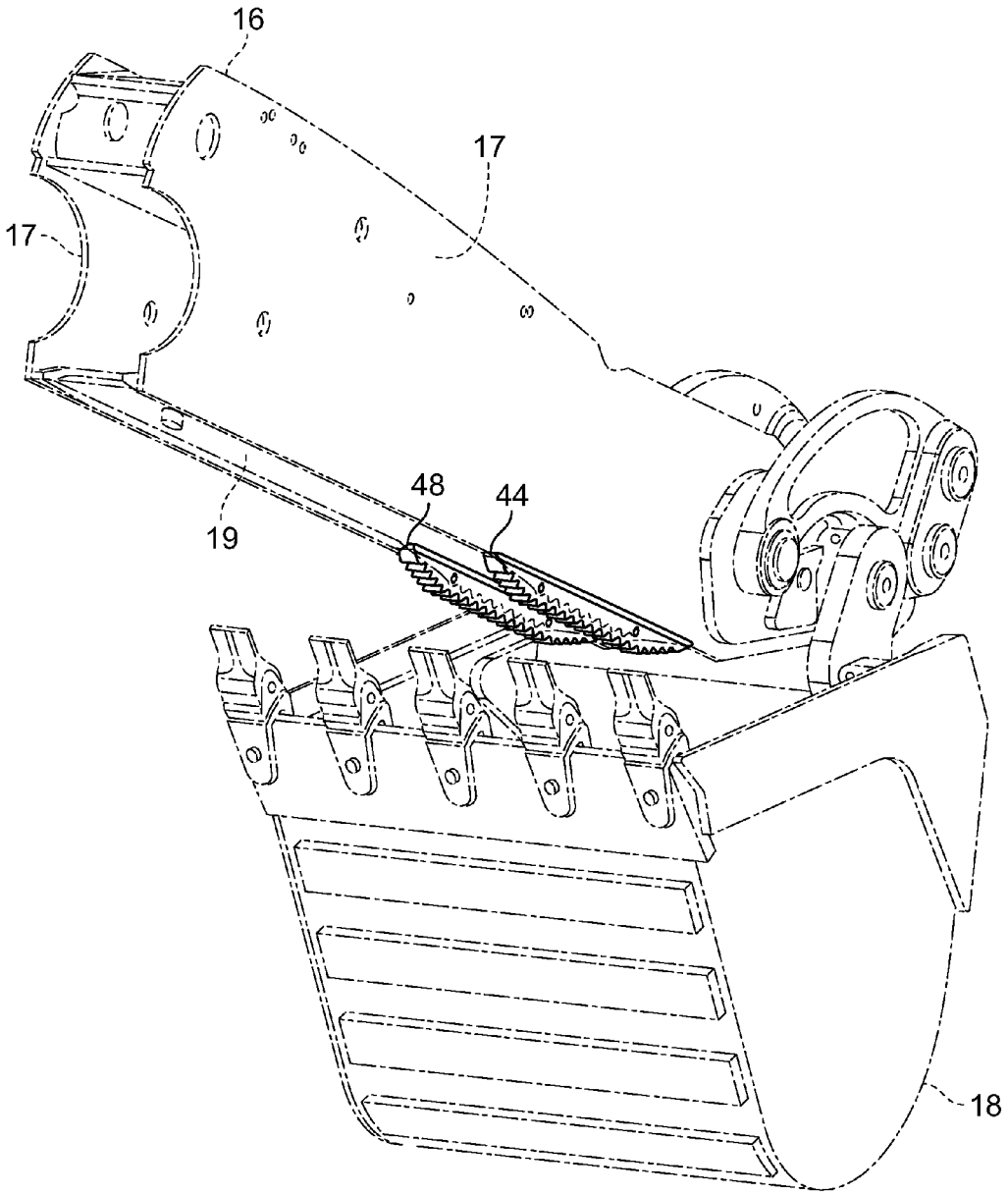

As shown in FIGS. 2A and 2B, a second gripping device 44 is removably secured to one or more of opposed side plates 17 of arm 16. In one embodiment, a bottom plate 19 is positioned between opposed side plates 17 of arm 16, forming a box structure for providing additional rigidity and structural strength of the arm 16.

Figure 3A:
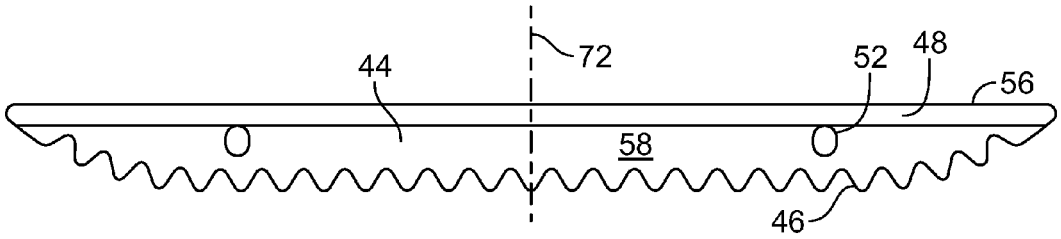
FIGS. 3A and 3B are orthogonal views of an exemplary embodiment of a second gripping device of the present disclosure.
Figure 3B:
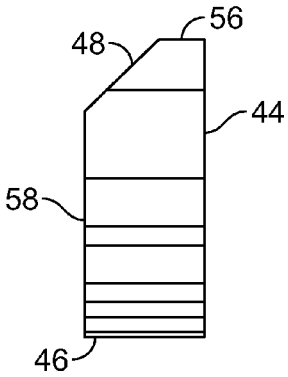
Figure 3C:
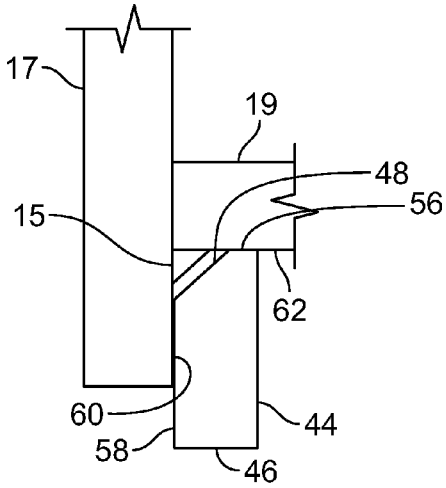
FIG. 3C is a partial, enlarged end view of the installed second gripping device of FIG. 2B of the present disclosure.

As shown in FIGS. 3A, 3B and 3C, second gripping device 44 includes a second gripping feature 46 for gripping objects between arm 16 and attachment 18 (FIG. 2A). In one embodiment, second gripping device 44 is sized or configured to at least partially secure an object between the second gripping device 44 and attachment 18. That is, second gripping device 44 may be sized and/or positioned to supplement the first gripping device 21 (FIGS. 4A, 4B) with gripping an object between arm 16 and attachment 18. Alternately, second gripping device 44 may be sized and/or positioned such that only second gripping device 44, and not first gripping device 21, is utilized with gripping an object between arm 16 and attachment 18. As further shown in FIG. 3B, second gripping device 44 further includes a formed profile 48, such as a chamfer, such that a surface 56 of second gripping device 44 opposite second gripping feature 46 and a surface 58 adjacent second gripping feature 46 may be brought into conformal contact with a pair of corresponding surfaces 60, 62 of respective side plate 17 and bottom plate 19 of arm 16, when second gripping device 44 is secured to arm 16. Stated another way, formed profile 48 of second gripping device 44 provides clearance of a weld joint or weld 15 securing side plate 17 and bottom plate 19 of arm 16 together. By virtue of this conformal contact, bottom plate 19 and side plate 17 of arm 16 provide structural support and rigidity to second gripping device 44.

Figure 4A:
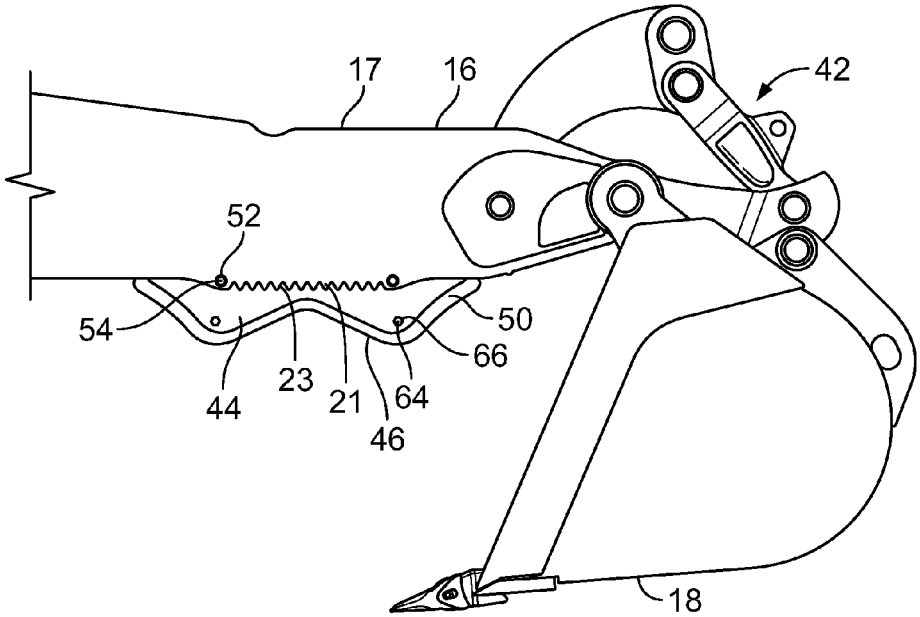
FIGS. 4A, 4B and 4C are different views of an alternate embodiment of a second gripping device installed on a work machine of the present disclosure.
Figure 4B:
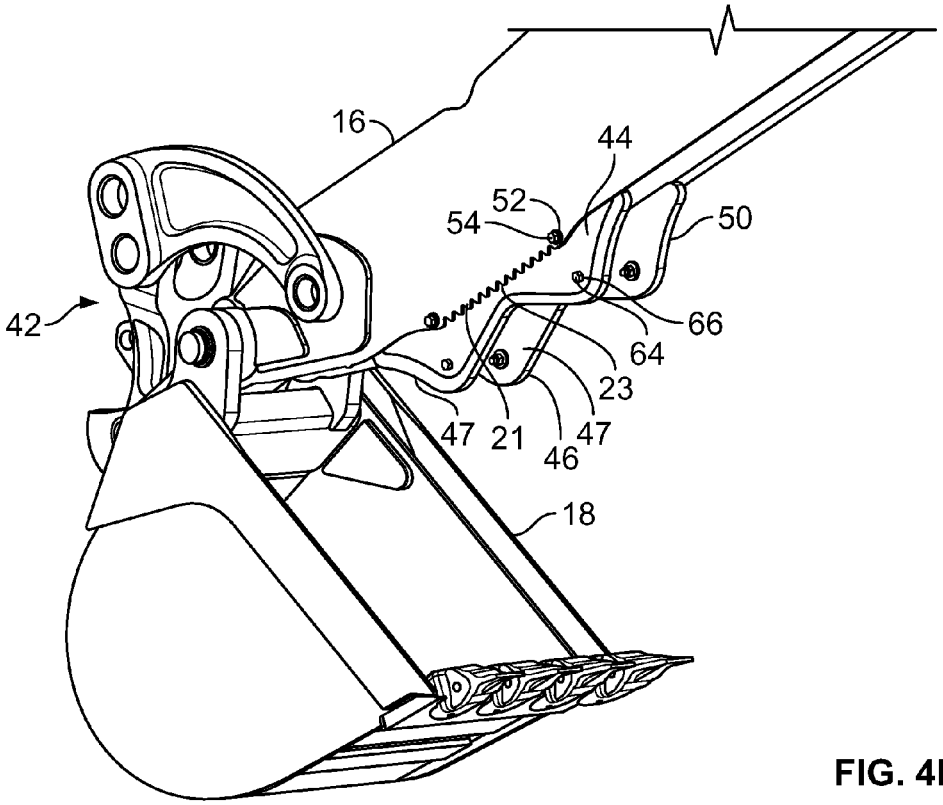
Figure 4C:
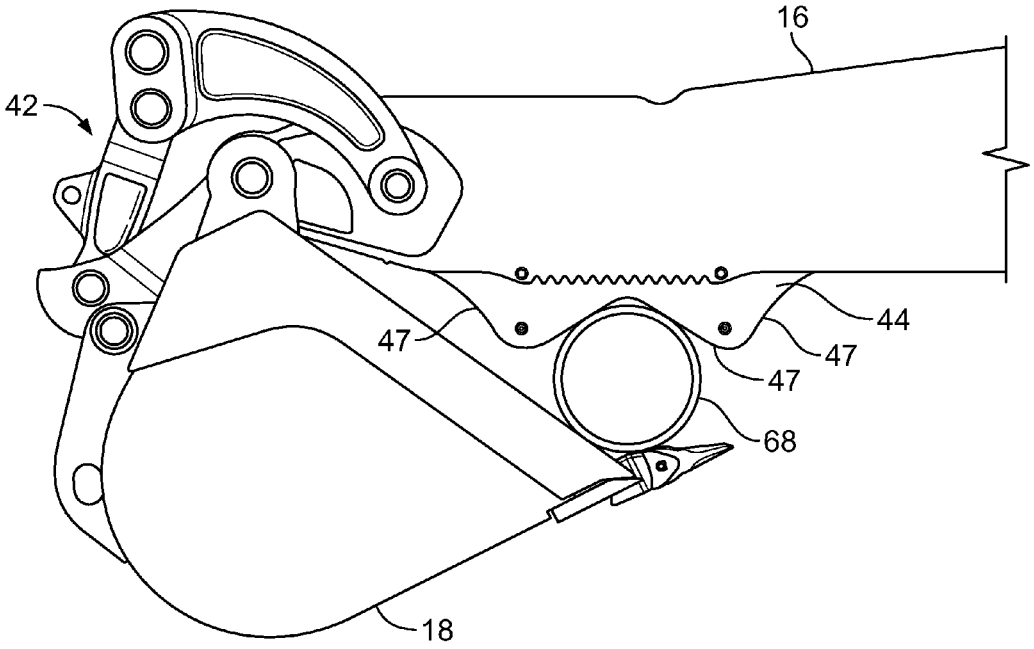
Figure 4D:
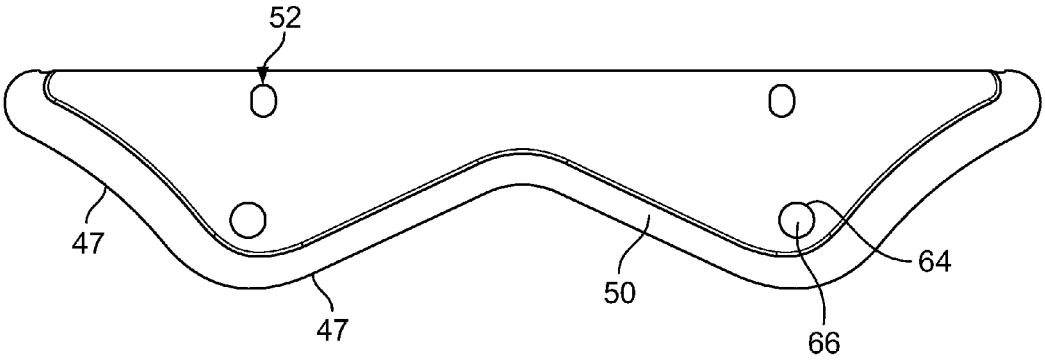
FIGS. 4D and 4E are different views of the embodiment of the second gripping device of FIGS. 4A, 4B and 4C of the present disclosure.
Figure 4E:
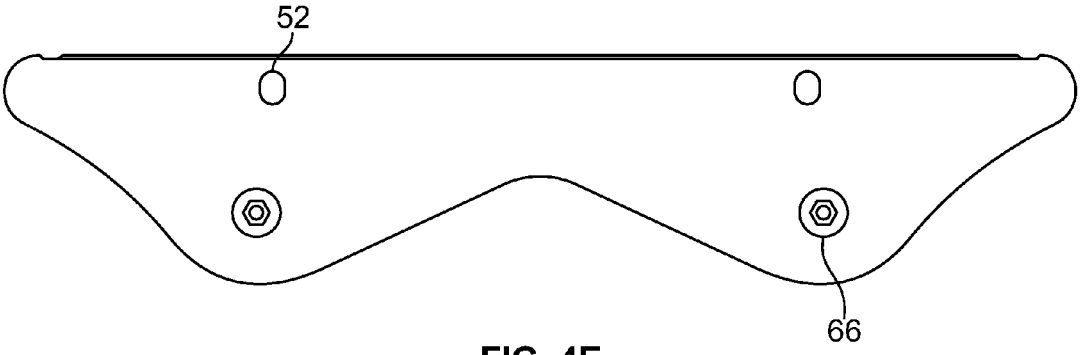
Figure 4F:
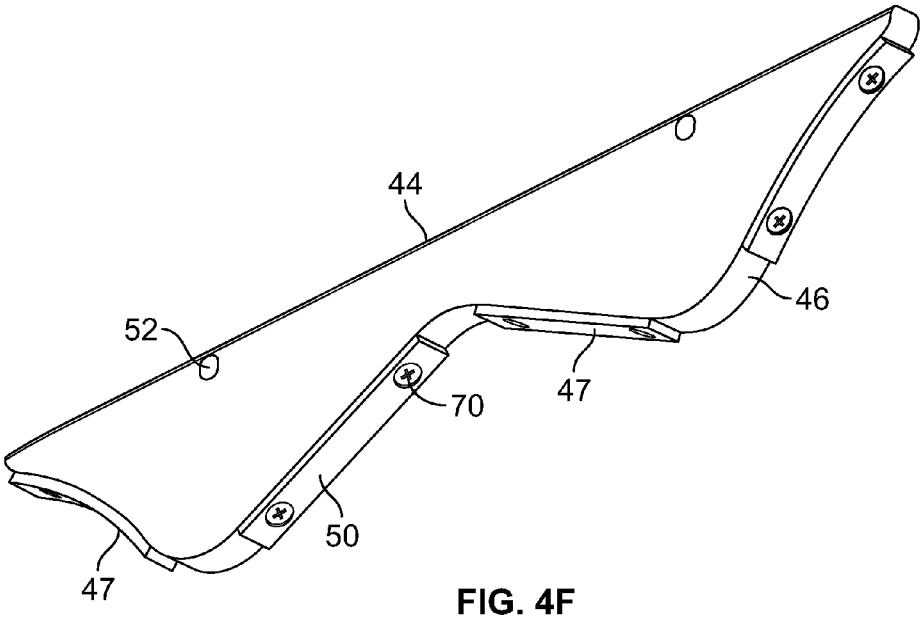
FIG. 4F is an alternate embodiment of the second gripping device of the present disclosure.

As further shown FIG. 3A, slots 52 formed in the second gripping device 44 corresponds to openings (not shown) formed in side plate 17 of arm 16 (see FIG. 4B). This arrangement, in combination with formed profile 48 as discussed above, permit second gripping device 44 to be interchangeably assembled to side plate 17 of arm 16. While not shown in the figures, it may be desirable to secure second gripping device 44 to side plate(s) 17 along a surface opposite surface 60 (see FIG. 3C). In one embodiment, second gripping device 44 may include a centerline 72 defining an axis of symmetry for the second gripping device. However, in another embodiment, second gripping device 44 is not symmetric about centerline 72.

It is to be understood that in one embodiment, first gripping feature 23 of first gripping device 21 may be similar to a corresponding second gripping feature 46 of second gripping device 44. However, in another embodiment, such as shown in FIGS. 4A, 4B, first gripping feature 23 of first gripping device 21 may be different from a corresponding second gripping feature 46 of second gripping device 44.

It is to be understood that in one embodiment, first gripping device 21 and second gripping device 44 may be formed using different heat treatment techniques. For example, it may be desirable that second gripping device 44 is formed using a heat treatment technique such that second gripping features 46 are "harder" than corresponding first gripping features 23 of first gripping device 21. Considerable cost savings may be realized by utilizing such a heat treatment technique for second gripping device 44, due to second gripping device 44 being much smaller than side plate 17 of arm 16 in which first gripping device 21 is integrally formed. In addition, use of second gripping device 44 in an environment with objects that have a high degree of abrasiveness would result in second gripping devices 44 being subjected to the abrasive environment, and not the corresponding first gripping device 21 of arm 16, thereby extending the service life of arm 16.

As further shown in FIGS. 4A, 4B, 4C, 4D, 4E, and 4F, second gripping device 44 includes a resilient layer 50, such as rubber or other suitable material, permitting gripping surfaces 47 associated with second gripping features 46 of second gripping device 44 to more gently manipulate objects 68 (FIG. 4C) such as a pipe. As further shown in FIGS. 4A, 4B, layer 50 is removably securable to second gripping device 44 using both fasteners 54 and corresponding slots 52 associated with arm 16 and second gripping device 44, as well as slots 64 and corresponding fasteners 66 associated with second gripping device 44 and layer 50. In one embodiment, layer 50 is molded such that at least a portion of layer 50 extends over at least a portion of second gripping feature 46. As further shown FIG. 4F, layer 50 includes strips that may be directly secured over gripping surface 47 of second gripping device 44. Fasteners 70 may include countersunk fasteners such that the fastener heads are recessed so that the surface of the strips associated with gripping surface 47 do not mar or otherwise contact a surface of an object that is to be manipulated by the working machine.

Figure 5A:
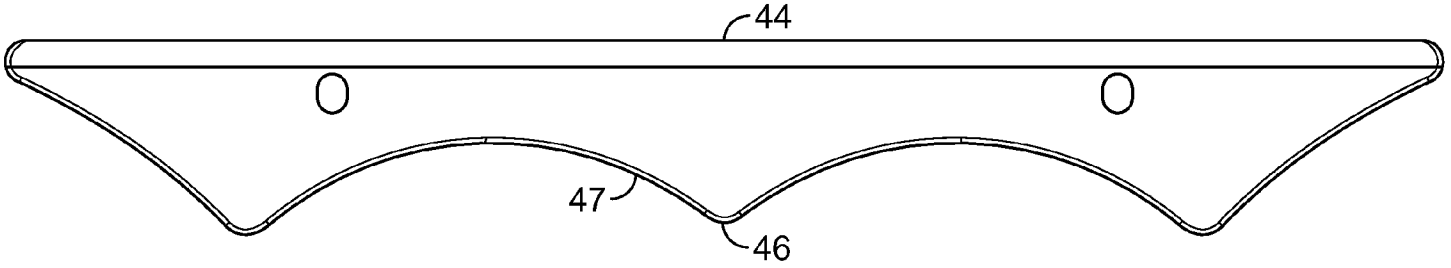
FIGS. 5A and 5B are alternate embodiments of a second gripping device of the present disclosure.
Figure 5B:
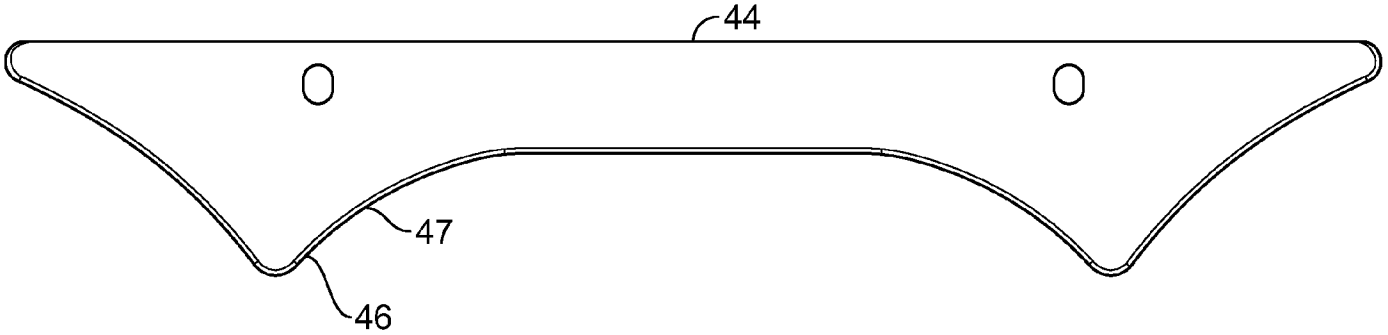
Figure 6:
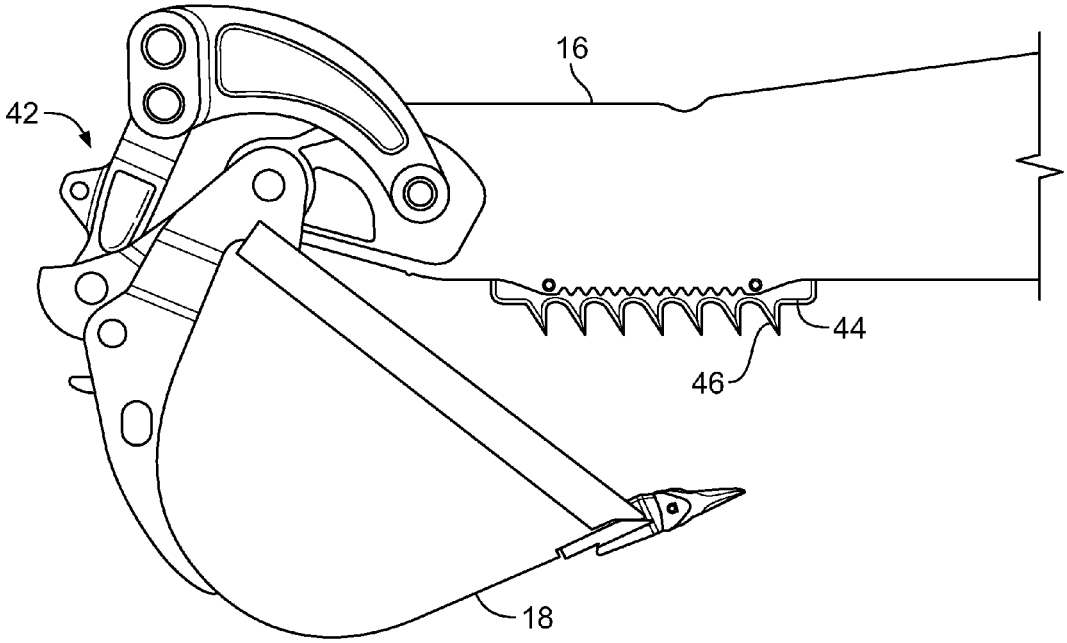
FIG. 6 is a view of a further embodiment of a second gripping device installed on a working machine of the present disclosure.

FIGS. 5A, 5B show different gripping surfaces 47 associated with different embodiments of second gripping devices 44, permitting, for example, effective use of gripping surfaces 47 with differently sized pipes or other objects. If desired, a resilient layer 50 such as previously discussed (see FIG. 4F) may be utilized. As further shown in FIG. 6, second gripping device 44 may include a second gripping feature 46 for different applications, such as a jagged teeth arrangement for use with brush or undergrowth or other suitable application.

While the disclosure has been described with reference to a preferred embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A work machine comprising:

a pivotable arm having a first gripping device formed within an edge of a side plate that extends beyond a bottom plate, the arm operatively connected to an attachment for securing an object between the first gripping device and the attachment; and a second gripping device removably securable to the arm near the first gripping device, the second gripping device configured to extend beyond a bottom of the pivotable arm at least as far as the first gripping device in a direction generally perpendicular to the arm for at least partially securing an object between the second gripping device and the attachment, wherein the first gripping device includes a first gripping feature and the second gripping device includes a second gripping feature, wherein the first gripping feature is different than the second gripping feature.

2. The machine of claim 1, wherein the first gripping feature is shaped and positioned substantially similar to the second gripping feature such that the first and second gripping features are positioned to grip jointly .

3. The machine of claim 1, wherein the second gripping device is composed of a material different than the first gripping device.

4. The machine of claim 1, wherein the second gripping device is removably secured to at least one side plate of the arm laterally adjacent to the first gripping device.

5. The machine of claim 1, wherein the second gripping device is interchangeably securable near the first gripping device, the second gripping device having a formed profile along a surface opposite the second gripping feature for permitting mutual conformal contact with the arm and with a side portion of the first gripping device.

6. The machine of claim 1, wherein the second gripping device including a layer of resilient material removably securable over at least a portion of the second gripping feature.

7. The machine of claim 6, wherein the layer is secured to the second gripping device along a surface adjacent to the second gripping feature.

8. The machine of claim 6, wherein the second gripping device is removably secured to one or more opposed side plates of the arm and a bottom plate is positioned between the opposed side plates and in and installed position the second gripping device abuts at least one side plate and the bottom plate.

9. A second gripping device removably securable to a pivotable arm of a work machine having a first gripping device having a first gripping feature formed within at least one sidewall of the arm the arm operatively connected to an attachment such that an object can be secured between the first gripping device and the attachment, the second gripping device removably securable to the arm generally laterally adjacent with the first gripping device, the second gripping device comprising a second gripping feature positioned at least as far outwardly from a base plate of the arm as the first gripping device.

10. The second gripping device of claim 9, wherein the first gripping device and second gripping device are located near a contact point between the attachment and the arm when the attachment is in a retracted position.

11. The second gripping device of claim 9 ,wherein the first gripping feature is substantially similar to the second gripping feature.

12. The second gripping device of claim 9, wherein the first gripping feature is different than the second gripping feature.

13. The second gripping device of claim 9, wherein the second gripping device is composed of a material different than the first gripping device.

14. The second gripping device of claim 9, wherein the second gripping device is removably secured to one or more opposed side plates of the arm and a bottom plate is positioned between opposed side walls and in an installed position the second gripping device abuts at least one side plate and the bottom plate.

15. The second gripping device of claim 10, wherein the second gripping device is interchangeably securable near the first gripping device, the second gripping device having a formed profile along a surface opposite the second gripping feature for permitting mutual conformal contact along a pair a corresponding surfaces between the second gripping device and the arm.

16. The second gripping device of claim 15, wherein the second gripping device including a layer of resilient material removably securable over at least a portion of the second gripping feature.

17. The machine of claim 16, wherein at least one sidewall of the arm has an attachment feature for removably securing the second gripping device.

* * * * *